US007699548B2

(12) United States Patent
Chikumoto

(10) Patent No.: US 7,699,548 B2
(45) Date of Patent: Apr. 20, 2010

(54) INK SHEET CARTRIDGE

(75) Inventor: Kouichi Chikumoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 883 days.

(21) Appl. No.: 11/447,171

(22) Filed: Jun. 6, 2006

(65) Prior Publication Data

US 2007/0036601 A1 Feb. 15, 2007

(30) Foreign Application Priority Data

Aug. 9, 2005 (JP) ..... 2005-231329

(51) Int. Cl.
*B41J 17/32* (2006.01)

(52) U.S. Cl. ..... 400/208; 400/207

(58) Field of Classification Search ..... 400/208, 400/207

See application file for complete search history.

(56) References Cited

U.S. PATENT DOCUMENTS

| | | | | |
|---|---|---|---|---|
| 4,160,605 | A * | 7/1979 | Neubaum | 400/208 |
| 5,399,035 | A | 3/1995 | Nakae | |
| 2002/0021926 | A1 | 2/2002 | Yamamoto et al. | |
| 2002/0060259 | A1 | 5/2002 | Kitayama | |

FOREIGN PATENT DOCUMENTS

| | | | |
|---|---|---|---|
| GB | 1 589 350 | A | 5/1981 |
| JP | 6-1054 | A | 1/1994 |
| JP | 6-183087 | A | 7/1994 |
| JP | 6-199388 | A | 7/1994 |
| JP | 2000224278 | A * | 8/2000 |
| JP | 2001-287432 | A | 10/2001 |

OTHER PUBLICATIONS

European Search Report dated Aug. 28, 2008 (six (6) pages).
Japanese Office Action dated Dec. 11, 2009 including English translation (Four (4) pages).

* cited by examiner

*Primary Examiner*—Ren Yan
*Assistant Examiner*—Allister Primo
(74) *Attorney, Agent, or Firm*—Crowell & Moring LLP

(57) ABSTRACT

An ink sheet cartridge, requiring no adhesive, capable of inhibiting the number of components from increase is obtained. This ink sheet cartridge comprises first and second case portions storing an ink sheet as well as a first hook portion and a first hook engaging portion integrally provided on the first and second case portions respectively. Either the first case portion or the second case portion is so slid as to engage the first hook portion with the first hook engaging portion, thereby fixing the first and second case portions to each other.

10 Claims, 10 Drawing Sheets

INK SHEET CARTRIDGE

BACKGROUND OF THE INVENTION

1. Field of the Invention

The present invention relates to an ink sheet cartridge, and more particularly, it relates to an ink sheet cartridge mounted on a printer.

2. Description of the Background Art

An ink sheet cartridge mounted on a printer is known in general, as disclosed in Japanese Patent Laying-Open No. 6-183087 (1994) or 6-199388 (1994), for example.

The aforementioned Japanese Patent Laying-Open No. 6-183087 describes an ink sheet cartridge comprising upper and lower shell halves rotatably storing a feed bobbin wound with an ink sheet and a take-up bobbin taking up a spent ink sheet respectively. A first end of the upper shell half is attached to a first end of the lower shell half in an openable/closable manner with a hinge, and the upper and lower shell halves are assembled with each other by engaging a hook provided on a second end of the upper shell half with an engaging hole provided on a second end of the lower shell half. In this ink sheet cartridge, protrusions are provided on both side ends of the upper and lower shell halves respectively. Separately formed holding members are fitted with the protrusions of the upper and lower shell halves assembled with each other, thereby suppressing disassembly of the upper and lower shell halves.

The aforementioned Japanese Patent Laying-Open No. 6-199388 describes an ink sheet cartridge comprising upper and lower shell halves rotatably storing a feed bobbin wound with an ink sheet and a take-up bobbin taking up a spent ink sheet respectively. A separately formed cover is mounted on the ink sheet cartridge for fixing the upper and lower shell halves to each other.

An ink sheet cartridge employed for a thermal transfer printer is also known in general. FIG. 16 is an exploded perspective view of a conventional ink sheet cartridge 100 employed for a thermal transfer printer. FIG. 17 is an overall perspective view of the conventional ink sheet cartridge 100 employed for a thermal transfer printer. FIG. 18 is a sectional view taken along the line 200-200 in FIG. 17. The structure of the conventional ink sheet cartridge 100 employed for a thermal transfer printer is described with reference to FIGS. 16 to 18.

The conventional ink sheet cartridge 100 employed for a thermal transfer printer comprises upper and lower components 102 and 103 of resin constituting a bobbin case 101, as shown in FIG. 16. The bobbin case 101 stores a feed bobbin 105 feeding an ink sheet 104, a take-up bobbin 106 taking up the ink sheet 104 and helical compression springs 107 for urging the feed bobbin 105 and the take-up bobbin 106 toward a first end of the bobbin case 101. Separately formed holding members 108 of resin are attached to both outer surfaces of the bobbin case 101 for holding the upper and lower components 102 and 103 in a state fixed to each other, as shown in FIGS. 16 and 17.

The upper component 102 constituting the bobbin case 101 includes a feed bobbin storage portion 102*a* storing the feed bobbin 105, a take-up bobbin storage portion 102*b* storing the take-up bobbin 106 and coupling portions 102*c* and 102*d* coupling the feed bobbin storage portion 102*a* and the take-up bobbin storage portion 102*b* with each other, as shown in FIG. 16. Protrusions 102*e* extending in parallel with the extensional direction of the feed bobbin storage portion 102*a* and the take-up bobbin storage portion 102*b* are provided on both outer surfaces of the upper component 102.

The lower component 103 constituting the bobbin case 101 includes a feed bobbin storage portion 103*a* storing the feed bobbin 105, a take-up bobbin storage portion 103*b* storing the take-up bobbin 106 and coupling portions 103*c* and 103*d* coupling the feed bobbin storage portion 103*a* and the take-up bobbin storage portion 103*b* with each other, as shown in FIG. 16. The feed bobbin storage portion 103*a* is provided therein with a feed bobbin support portion 103*e* rotatably supporting the feed bobbin 105, while the take-up bobbin storage portion 103*b* is provided therein with a take-up bobbin support portion 103*f* rotatably supporting the take-up bobbin 106. Protrusions 103*g* extending in parallel with the extensional direction of the feed bobbin storage portion 103*a* and the take-up bobbin storage portion 103*b* are provided on both outer surfaces of the lower component 103.

The feed bobbin 105 is provided with a sheet feed shaft 105*a* wound with the ink sheet 104, a flange 105*b*, a drive shaft 105*d* and a driven shaft 105*d*, as shown in FIG. 16. The take-up bobbin 106 is provided with a sheet take-up shaft 106*a* taking up the ink sheet 104, a flange 106*b*, a drive shaft 106*c* and a driven shaft 106*d*, as shown in FIG. 16. Each of the holding members 108 has a U-shaped section, as shown in FIGS. 16 to 18.

A method of assembling the upper and lower components 102 and 103 of the conventional ink sheet cartridge 100 employed for a thermal transfer printer is now described with reference to FIGS. 16 to 18. First, the helical compression springs 107 are set on the driven shafts 105*d* and 106*d* of the feed bobbin 105 and the take-up bobbin 106 respectively, as shown in FIG. 16. Then, the feed bobbin 105 and the take-up bobbin 106 are arranged to be supported by the feed bobbin support portion 103*e* and the take-up bobbin support portion 103*f* of the feed bobbin storage portion 103*e* and the take-up bobbin storage portion 103*b* of the lower component 103 respectively. Thereafter an adhesive is applied to contact surfaces of the upper and lower components 102 and 103 coming into contact with each other when the upper and lower components 102 and 103 fixed to each other. More specifically, the adhesive is applied to contact surfaces of the coupling portions 102*c* and 102*d* of the upper component 102, those of the protrusions 102*e* provided on both side surfaces of the upper component 102, those of the coupling portions 103*c* and 103*d* of the lower component 103 and those of the protrusions 103*g* provided on both side surfaces of the lower component 103 respectively. The upper and lower components 102 and 103 are so butted to each other that the contact surfaces thereof come into contact with each other. Thereafter the holding members 108 coated with an adhesive are fitted with the contact portions between the protrusions 102*e* and 103*g* of the upper and lower components 102 and 103, as shown in FIGS. 17 and 18. Thus, the upper and lower components 102 and 103 of the ink sheet cartridge 100 are fixed to and assembled with each other.

In the conventional ink sheet cartridge 100 shown in FIGS. 16 to 18, however, the upper and lower components 102 and 103 are held in the fixed state by fitting the separately formed holding members 108 of resin with the protrusions 102*e* and 103*g* provided on both side surfaces of the ink sheet cartridge 100, and hence the holding members 108 are disadvantageously necessary in order to fix the upper and lower components 102 and 103 to each other. Thus, the number of components is disadvantageously increased. In the conventional ink sheet cartridge 100 shown in FIGS. 16 to 18, further, the upper and lower components 102 and 103 are fixed to each other with the adhesive and thereafter held in the fixed state with the holding members 108, and hence the adhesive is disadvantageously necessary.

In the ink sheet cartridge disclosed in the aforementioned Japanese Patent Laying-Open No. 6-183087, on the other hand, the separately formed holding members must be fitted with the protrusions provided on the upper and lower shell halves respectively in order to suppress disassembly of the upper and lower shell halves, and hence the number of components is disadvantageously increased.

In the ink sheet cartridge disclosed in the aforementioned Japanese Patent Laying-Open No. 6-199388, further, the separately formed cover must be attached in order to fix the upper and lower shell halves to each other, and hence the number of components is disadvantageously increased due to the provision of the cover.

SUMMARY OF THE INVENTION

The present invention has been proposed in order to solve the aforementioned problems, and an object of the present invention is to provide an ink sheet cartridge, requiring no adhesive, capable of inhibiting the number of components from increase.

An ink sheet cartridge according to a first aspect of the present invention comprises an ink sheet for printing, a first case portion and a second case portion each including a pair of ink sheet storage portions storing the ink sheet, a first hook portion integrally provided on either the first case portion or the second case portion and a first hook engaging portion integrally provided on either the second case portion or the first case portion for engaging with the first hook portion, for horizontally sliding either the first case portion or the second case portion while deviating the first case portion and the second case portion from each other by a prescribed distance thereby engaging the first hook portion with the first hook engaging portion and fixing the first case portion and the second case portion to each other.

In the ink sheet cartridge according to the first aspect of the present invention, as hereinabove described, the first hook portion is integrally provided on either the first case portion or the second case portion while the first hook engaging portion engaging with the first hook portion is integrally provided on either the second case portion or the first case portion so that the number of components can be inhibited from increase despite the provision of the first hook portion and the first hook engaging portion and the first and second case portions can be fixed to each other through the first hook portion and the first hook engaging portion without employing an adhesive. Further, either the first case portion or the second case portion is horizontally slid while the first and second case portions are deviated from each other by the prescribed distance thereby engaging the first hook portion with the first hook engaging portion and fixing the first and second case portions to each other so that no load is applied except in the sliding direction when the first or second case portion is horizontally slid, whereby the first or second case portion can be inhibited from deflection dissimilarly to a case of vertically fixing the first and second case portions to each other while deflecting either the first case portion or the second case portion. Thus, the feed bobbin and the take-up bobbin stored in the ink sheet cartridge are not displaced by deflection of the first or second case portion, whereby the first and second case portions can be easily fixed to each other.

In the aforementioned ink sheet cartridge according to the first aspect, the first hook engaging portion preferably includes an engaging hole engaging with the first hook portion. According to this structure, the first and second case portions can be easily fixed to each other by engaging the first hook portion with the engaging hole of the first hook engaging portion.

In the aforementioned ink sheet cartridge according to the first aspect, the first hook portion and the first hook engaging portion preferably engage with each other at least in the vertical direction. According to this structure, the first and second case portions can be inhibited from separation at least in the vertical direction.

In the aforementioned ink sheet cartridge according to the first aspect, first hook portions are preferably provided on regions corresponding to the pair of ink sheet storage portions of either the first case portion or the second case portion respectively, and first hook engaging portions are preferably provided on regions corresponding to the pair of ink sheet storage portions of either the second case portion or the first case portion respectively. According to this structure, the pairs of ink sheet storage portions of the first and second case portions can be inhibited from separation.

In the aforementioned ink sheet cartridge according to the first aspect, a first coupling portion and a second coupling portion coupling the pair of ink sheet storage portions with each other are preferably provided in the vicinity of both side end surfaces of the first case portion respectively, a third coupling portion and a fourth coupling portion coupling the pair of ink sheet storage portions with each other are preferably provided in the vicinity of both side end surfaces of the second case portion respectively, and the first coupling portion of the first case portion and the third coupling portion of the second case portion are preferably provided with a first engaging portion and a second engaging portion engaging with each other when either the first case portion or the second case portion is horizontally slid while the first case portion and the second case portion are deviated from each other by the prescribed distance. According to this structure, the first and third coupling portions can be inhibited from separation without employing an adhesive due to the engagement between the first and second engaging portions.

In this case, the first case portion is preferably arranged on the second case portion, and the first engaging portion of the first case portion and the second engaging portion of the second case portion preferably vertically engage with each other. According to this structure, the first and third coupling portions of the first and second case portions can be inhibited from vertical separation.

In the aforementioned ink sheet cartridge according to the first aspect, a pair of first protrusions are preferably provided in the vicinity of both ends of a side end surface of the first case portion while a pair of first fitting portions receiving the pair of first protrusions are preferably provided in the vicinity of both ends of a side end surface of the second case portion, a pair of second fitting portions are preferably provided in the vicinity of both ends of another side end surface of the first case portion while a pair of second protrusions inserted into the pair of second fitting portions are preferably provided in the vicinity of both ends of another side end surface of the second case portion, and the pair of first protrusions are preferably inserted into the pair of first fitting portions and the pair of second protrusions are preferably inserted into the pair of second fitting portions when either the first case portion or the second case portion is horizontally slid while the first case portion and the second case portion are deviated from each other by the prescribed distance. According to this structure, four corners of the first case portion and those of the second case portion are fixed to each other upon assembling of the first and second case portions, whereby these corners of the first and second case portions can be inhibited from separation.

In the aforementioned ink sheet cartridge having the pair of first protrusions inserted into the pair of first fitting portions and the pair of second protrusions inserted into the pair of second fitting portions, the first case portion is preferably arranged on the second case portion, the first protrusions of the first case portion and the first fitting portions of the second case portion preferably vertically engage with each other, and the second fitting portions of the first case portion and the second protrusions of the second case portion preferably vertically engage with each other. According to this structure, the first and second case portions can be inhibited from vertical separation.

In the aforementioned ink sheet cartridge having the pair of first protrusions inserted into the pair of first fitting portions and the pair of second protrusions inserted into the pair of second fitting portions, a first coupling portion and a second coupling portion coupling the pair of ink sheet storage portions with each other are preferably provided in the vicinity of both side end surfaces of the first case portion respectively, a third coupling portion and a fourth coupling portion coupling the pair of ink sheet storage portions with each other are preferably provided in the vicinity of both side end surfaces of the second case portion respectively, a pair of the first hook portions are preferably provided either on a side of the first case portion closer to the second coupling portion than the first protrusions or on a side of the second case portion closer to the fourth coupling portion than the first fitting portions, and a pair of the first hook engaging portions are preferably provided either on the side of the second case portion closer to the fourth coupling portion than the first fitting portions or on the side of the first case portion closer to the second coupling portion than the first protrusions. According to this structure, the first hook portions and the first hook engaging portions can be easily engaged with each other in the vicinity of the second and fourth coupling portions, thereby inhibiting the second and fourth coupling portions from separation.

In the aforementioned ink sheet cartridge according to the first aspect, second hook portions for fixing the sliding direction of the first case portion and the second case portion are preferably provided on the outer surfaces of the ink sheet storage portions of the first case portion to extend substantially in parallel with the extensional direction of the ink sheet storage portions, and second hook engaging portions engaging with the second hook portions are preferably provided on the outer surfaces of the ink sheet storage portions of the second case portion. According to this structure, the second hook portions and the second hook engaging portions so engage with each other as to inhibit the first or second case portion from movement in the sliding direction, whereby the first and second case portions can be inhibited from cancellation of the fixed state resulting from movement of the first or second case portion in the sliding direction.

In this case, the second hook portions of the first case portion and the second hook engaging portions of the second case portion preferably engage with each other in the sliding direction. According to this structure, the first and second case portions can be easily inhibited from cancellation of the fixed state resulting from movement of the first or second case portion in the sliding direction.

An ink sheet cartridge according to a second aspect of the present invention comprises an ink sheet for printing as well as a first case portion and a second case portion each including a pair of ink sheet storage portions storing the ink sheet, while the first case portion is integrally provided with a first hook engaging portion, the second case portion is integrally provided with a first hook portion engaging with the first hook engaging portion, a first coupling portion and a second coupling portion coupling the pair of ink sheet storage portions with each other are provided in the vicinity of both side end surfaces of the first case portion respectively, a third coupling portion and a fourth coupling portion coupling the pair of ink sheet storage portions with each other are provided in the vicinity of both side end surfaces of the second case portion respectively, a pair of first protrusions are provided in the vicinity of both ends of a side end surface of the first case portion while a pair of first fitting portions receiving the pair of first protrusions are provided in the vicinity of both ends of a side end surface of the second case portion, a pair of second fitting portions are provided in the vicinity of both ends of another side end surface of the first case portion while a pair of second protrusions inserted into the pair of second fitting portions are provided in the vicinity of both ends of another side end surface of the second case portion, second hook portions for fixing the sliding direction of the first case portion and the second case portion are provided on the outer surfaces of the ink sheet storage portions of the first case portion to extend substantially in parallel with the extensional direction of the ink sheet storage portions, second hook engaging portions engaging with the second hook portions are provided on the outer surfaces of the ink sheet storage portions of the second case portion, a pair of the first hook engaging portions are provided on a side of the first case portion closer to the second coupling portion than the first protrusions, a pair of the first hook portions are provided on a side of the second case portion closer to the fourth coupling portion than the first fitting portions, and the first coupling portion of the first case portion and the third coupling portion of the second case portion are provided with a first engaging portion and a second engaging portion engaging with each other respectively, for horizontally sliding either the first case portion or the second case portion while deviating the first case portion and the second case portion from each other by a prescribed distance thereby engaging the first hook portions with the first hook engaging portions, inserting the pair of first protrusions into the pair of first fitting portions and inserting the pair of second protrusions into the pair of second fitting portions while engaging the first engaging portion of the first coupling portion and the second engaging portion of the third coupling portion with each other thereby fixing the first case portion and the second case portion to each other.

In the ink sheet cartridge according to the second aspect of the present invention, as hereinabove described, the first hook portions are integrally provided on the first case portion while the first hook engaging portions engaging with the first hook portions are integrally provided on the second case portion so that the number of components can be inhibited from increase despite the provision of the first hook portions and the first hook engaging portions and the first and second case portions can be fixed to each other through the first hook portions and the first hook engaging portions without employing an adhesive. Further, either the first case portion or the second case portion is horizontally slid while the first and second case portions are deviated from each other by the prescribed distance thereby engaging the first hook portions with the first hook engaging portions and fixing the first and second case portions to each other so that no load is applied except in the sliding direction when the first or second case portion is horizontally slid, whereby the first or second case portion can be inhibited from deflection dissimilarly to a case of vertically fixing the first and second case portions to each other while deflecting either the first case portion or the second case portion. Thus, the feed bobbin and the take-up bobbin stored in the ink sheet cartridge are not displaced by deflection of the first or second case portion, whereby the first and second case portions can be easily fixed to each other. In addition, the first and third coupling portions coupling the pairs of ink sheet storage portions with each other are provided on the first and second case portions respectively while the first and third coupling portions of the first and second case portions are provided with the first and second engaging portions engaging with each other when the first or second case portion is slid while the first and second case portions are deviated from each other by the prescribed distance respectively, whereby the first and second coupling portions can be inhibited from separation due to the engagement between the first and second engaging portions without employing an adhesive.

According to the second aspect, the pair of first protrusions are provided in the vicinity of both ends of the side end surface of the first case portion while the pair of first fitting portions receiving the pair of first protrusions are provided in the vicinity of both ends of the side end surface of the second case portion, the pair of second fitting portions are provided in the vicinity of both ends of the other side end surface of the first case portion while the pair of second protrusions inserted into the pair of second fitting portions are provided in the vicinity of both ends of the other side end surface of the second case portion for fixing four corners of the first case portion and those of the second case portion to each other by horizontally sliding either the first case portion or the second case portion while deviating the first and second case portions from each other by the prescribed distance thereby inserting the pair of first protrusions and the pair of second protrusions into the pair of first fitting portions and the pair of second fitting portions respectively so that the corners of the first and second case portions can be inhibited from separation. Further, the second hook portions for fixing the sliding direction of the first case portion and the second case portion are provided on the outer surfaces of the ink sheet storage portions of the first case portion to extend substantially in parallel with the extensional direction of the ink sheet storage portions while the second hook engaging portions engaging with the second hook portions are provided on the outer surfaces of the ink sheet storage portions of the second case portion so that the second hook portions and the second hook engaging portions engage with each other thereby inhibiting the first or second case portion from movement in the sliding direction, whereby the first and second case portions can be inhibited from cancellation of the fixed state resulting from movement of the first or second case portion in the sliding direction. The pair of first hook engaging portions are provided on the side of the first case portion closer to the second coupling portion than the first protrusions and the pair of first hook portions are provided on the side of the second case portion closer to the fourth coupling portion than the first fitting portions, whereby the first hook portions and the first hook engaging portions can be easily engaged with each other in the vicinity of the second and fourth coupling portions, and therefore, the second and fourth coupling portions can be inhibited from separation.

In the aforementioned ink sheet cartridge according to the second aspect, the first hook engaging portions preferably include engaging holes engaging with the first hook portions. According to this structure, the first and second case portions can be easily fixed to each other by engaging the first hook portions in the engaging holes of the first hook engaging portions.

In the aforementioned ink sheet cartridge according to the second aspect, the first hook portions and the first hook engaging portions preferably engage with each other at least in the vertical direction. According to this structure, the first and second case portions can be inhibited from separation at least in the vertical direction.

In the aforementioned ink sheet cartridge according to the second aspect, the first hook portions are preferably provided on regions corresponding to the pair of ink sheet storage portions of either the first case portion or the second case portion respectively, and the first hook engaging portions are preferably provided on regions corresponding to the pair of ink sheet storage portions of either the second case portion or the first case portion respectively. According to this structure, the pairs of ink sheet storage portions of the first and second case portions can be inhibited from separation.

In the aforementioned ink sheet cartridge according to the second aspect, the first case portion is preferably arranged on the second case portion, and the first engaging portion of the first case portion and the second engaging portion of the second case portion preferably vertically engage with each other. According to this structure, the first and third coupling portions of the first and second case portions can be inhibited from vertical separation.

In the aforementioned ink sheet cartridge according to the second aspect, the first case portion is preferably arranged on the second case portion, the first protrusions of the first case portion and the first fitting portions of the second case portion preferably vertically engage with each other, and the second fitting portions of the first case portion and the second protrusions of the second case portion preferably vertically engage with each other. According to this structure, the first and second case portions can be inhibited from vertical separation.

In the aforementioned ink sheet cartridge according to the second aspect, the second hook portions of the first case portion and the second hook engaging portions of the second case portion preferably engage with each other in the sliding direction. According to this structure, the first and second case portions can be easily inhibited from cancellation of the fixed state resulting from movement of the first or second case portion in the sliding direction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of an ink sheet cartridge 1 according to the embodiment of the present invention is described with reference to FIGS. 1 to 9.

Figure 1:
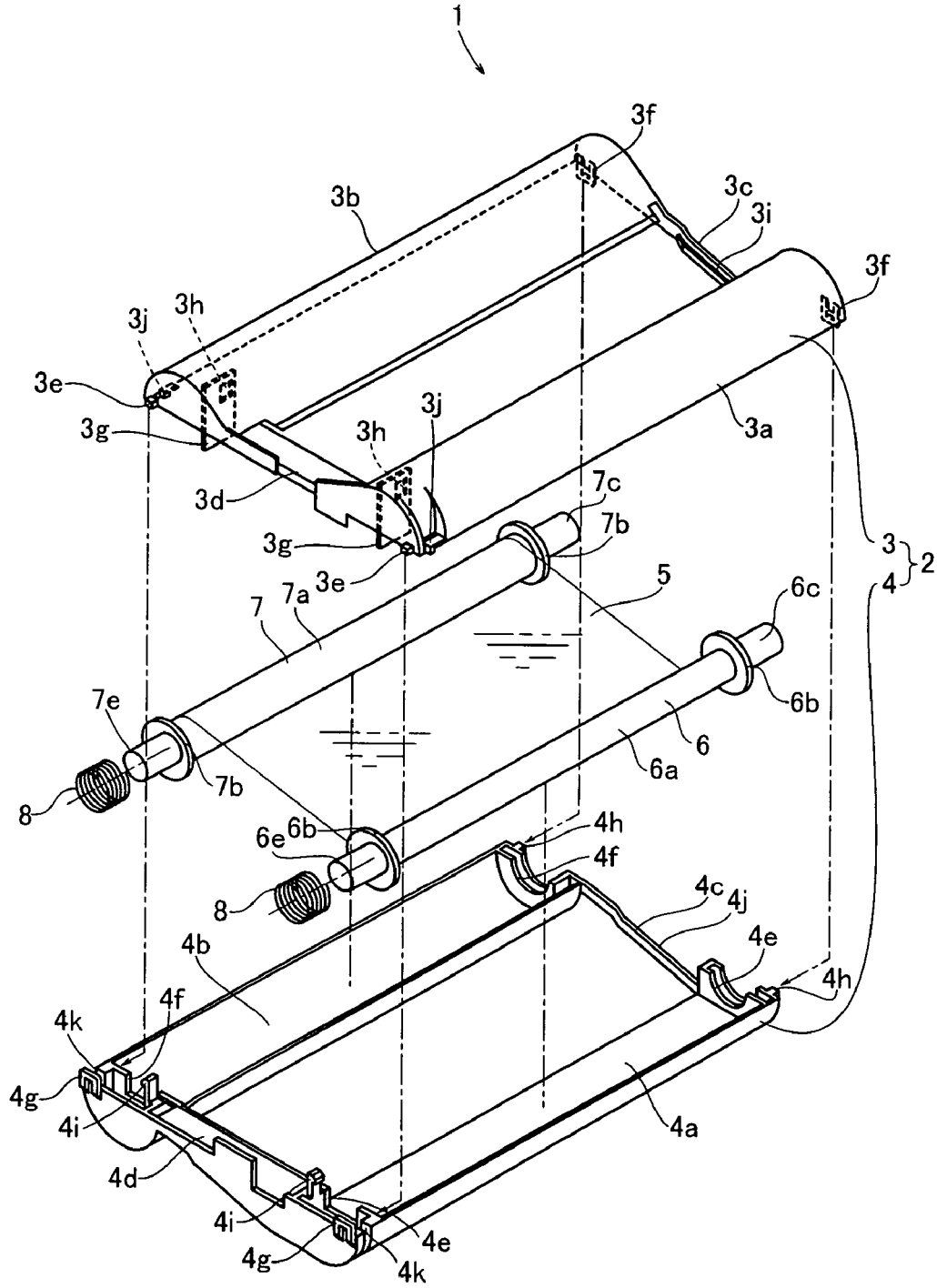
FIG. 1 is an exploded perspective view of an ink sheet cartridge according to an embodiment of the present invention.
Figure 2:
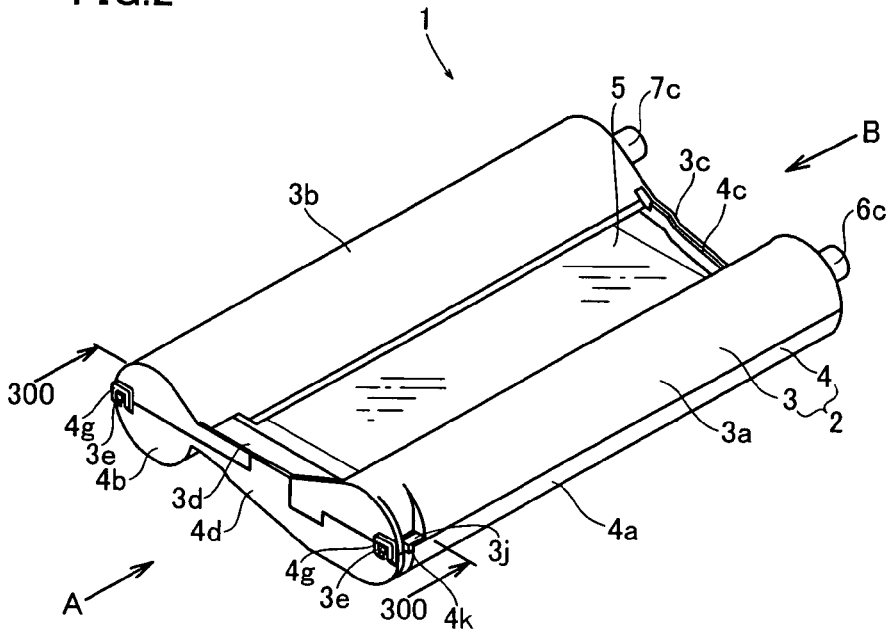
FIG. 2 is an overall perspective view of the ink sheet cartridge according to the embodiment of the present invention shown in FIG. 1.
Figure 4:
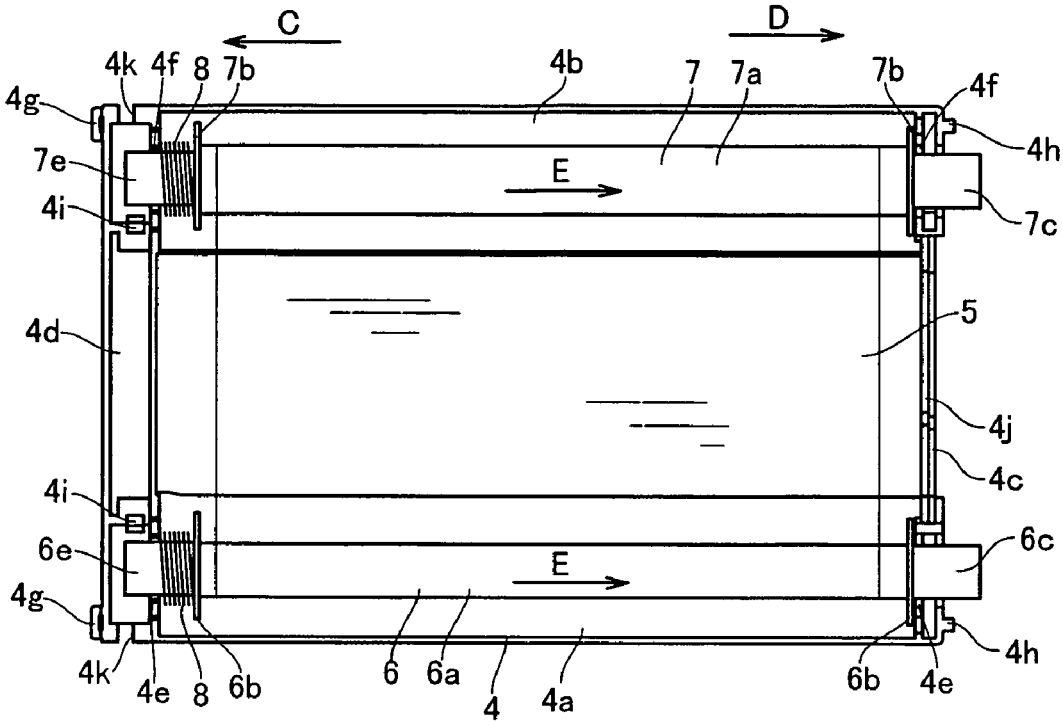
FIG. 4 is a plan view of a lower component of the ink sheet cartridge according to the embodiment of the present invention shown in FIG. 1.

The ink sheet cartridge 1 according to the embodiment of the present invention comprises upper and lower components 3 and 4 of resin constituting a bobbin case 2, as shown in FIGS. 1 and 2. The upper and lower components 3 an 4 are examples of the "first case portion" and the "second case portion" in the present invention respectively. The bobbin case 2 stores a feed bobbin 6 feeding an ink sheet 5, a take-up bobbin 7 taking up the ink sheet 5 and helical coil springs 8 for urging the feed bobbin 6 and the take-up bobbin 7 toward an end of the bobbin case 2, as shown in FIGS. 1 and 4.

Figure 3:
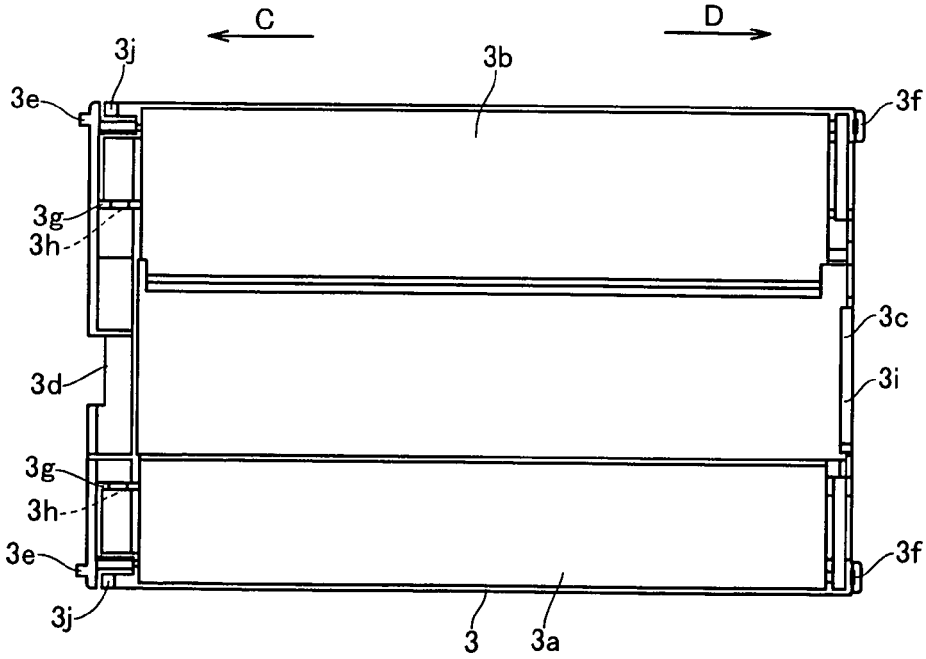
FIG. 3 is a plan view of an upper component of the ink sheet cartridge according to the embodiment of the present invention shown in FIG. 1 as viewed from inside.

As shown in FIG. 3, the upper component 3 constituting the bobbin case 2 includes a feed bobbin storage portion 3*a* storing the feed bobbin 6, a take-up bobbin storage portion 3*b* storing the take-up bobbin 7 and coupling portions 3*c* and 3*d* coupling the feed bobbin storage portion 3*a* and the take-up bobbin storage portion 3*b* with each other. The feed bobbin storage portion 3*a* and the take-up bobbin storage portion 3*b* are examples of the "pair of ink sheet storage portions" in the present invention. The coupling portions 3*c* and 3*d* are examples of the "first coupling portion" and the "second coupling portion" in the present invention respectively.

Figure 5:
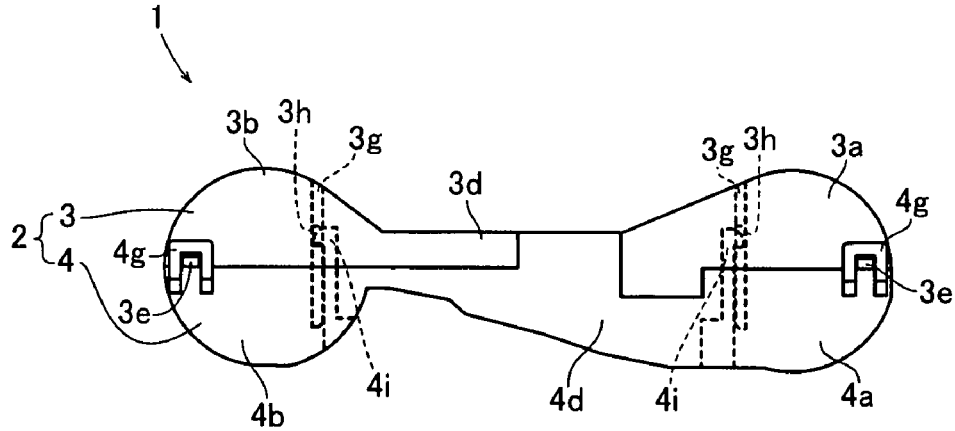
FIG. 5 is a side elevational view of the ink sheet cartridge as viewed along arrow A in FIG. 2.
Figure 6:
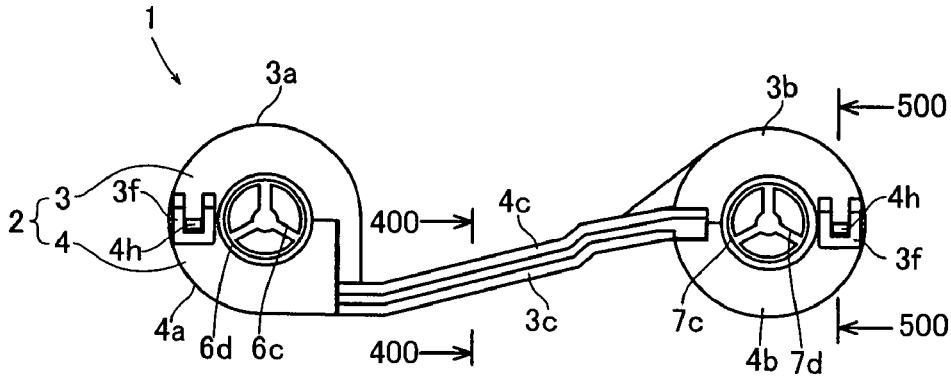
FIG. 6 is a side elevational view of the ink sheet cartridge as viewed along arrow B in FIG. 2.

According to this embodiment, a pair of protrusions 3*e* are integrally provided in the vicinity of both ends of a side end surface of the upper component 3 along arrow C, as shown in FIG. 3. Further, a pair of fitting portions 3*f* are integrally provided in the vicinity of both ends of another side end surface of the upper component 3 along arrow D. The protrusions 3*e* are examples of the "first protrusions" in the present invention. The fitting portions 3*f* are examples of the "second fitting portions" in the present invention. In addition, a pair of hook engaging portions 3*g* are integrally provided on the side end surface of the upper component 3 along arrow C, as shown in FIG. 3. The pair of hook engaging portions 3*g* are provided on regions of the upper component 3 corresponding to the feed bobbin storage portion 3*a* and the take-up bobbin storage portion 3*b* respectively, as shown in FIGS. 1 and 3. The hook engaging portions 3*g* are examples of the "first hook engaging portion(s)" in the present invention. The pair of hook engaging portions 3*g* are constituted of plate members having engaging holes 3*h*, as shown in FIG. 1. The engaging holes 3*h* are so formed as to engage with the forward ends of hook portions 4*i* described later with no clearances in the vertical direction and a sliding direction (horizontal direction) upon engagement between the hook engaging portions 3*g* and the hook portions 4*i*. Further, the pair of hook engaging portions 3*g* are provided on positions of the upper component 3 closer to the coupling portion 3*d* than the protrusions 3*e*, as shown in FIGS. 3 and 5. In addition, the hook engaging portions 3*g* extend toward the bottom surface of the lower component 4 when the upper and lower components 3 and 4 are assembled with each other, as shown in FIG. 5.

According to this embodiment, an L-shaped coupling portion fixing engaging portion 3*i* (see FIG. 7) is provided on the coupling portion 3*c* of the upper component 3 along arrow D, as shown in FIG. 3. The coupling portion fixing engaging portion 3*i* is an example of the "first engaging portion" in the present invention. Sliding direction fixing hook portions 3*j* are provided on both side surfaces of the end of the upper component 3 along arrow C, to extend in parallel with the extensional direction of the feed bobbin storage portion 3*a* and the take-up bobbin storage portion 3*b*. The sliding direction fixing hook portions 3*j* are examples of the "second hook portions" in the present invention.

As shown in FIG. 1, the lower component 4 constituting the bobbin case 2 includes a feed bobbin storage portion 4*a* storing a feed bobbin 6, a take-up bobbin storage portion 4*b* storing the take-up bobbin 7 and coupling portions 4*c* and 4*d* coupling the feed bobbin storage portion 4*a* and the take-up bobbin storage portion 4*b* with each other. The feed bobbin storage portion 4*a* and the take-up bobbin storage portion 4*b* are examples of the "pair of ink sheet storage portions". The coupling portions 4*c* and 4*d* are examples of the "third coupling portion" and the "fourth coupling portion" in the present invention respectively. The feed bobbin storage portion 4*a* is provided therein with a feed bobbin support portion 4*e* rotatably supporting the feed bobbin 6, while the take-up bobbin storage portion 4*b* is provided therein with a take-up bobbin support portion 4*f* rotatably supporting the take-up bobbin 7.

According to this embodiment, a pair of fitting portions 4*g* are integrally provided in the vicinity of both ends of a side end surface of the lower component 4 along arrow C for receiving the pair of protrusions 3*e* of the upper component 3 respectively, as shown in FIG. 4. The pair of fitting portions 4*g* and the pair of protrusions 3*e* vertically engage with each other. Further, a pair of protrusions 4*h* (see FIG. 9) are integrally provided in the vicinity of both ends of another side end surface of the lower component 4 along arrow D, to be inserted in to the pair of fitting portions 3*f* of the upper component 3 respectively. The pair of protrusions 4*h* and the pair of fitting portions 3*f* vertically engage with each other. The fitting portions 4*g* are examples of the "first fitting portions" in the present invention. The protrusions 4*h* are examples of the "second protrusions" in the present invention. As shown in FIG. 4, further, a pair of hook portions 4*i* are integrally provided on the side end of the lower component 4 along arrow C for engaging with the pair of hook engaging portions 3*g* of the upper component 3. The pair of hook portions 4*i* are provided on regions of the lower component 4 corresponding to the feed bobbin storage portion 4*a* and the take-up bobbin storage portion 4*b* respectively, as shown in FIGS. 1 and 4. The hook portions 4*i* are examples of the "first hook portion" in the present invention. The pair of hook portions 4*i* are provided on positions of the lower component 4 closer to the coupling portion 4*d* than the fitting portions 4*g*, as shown in FIGS. 4 and 5. Further, the hook portions 4*i* extend toward the upper surface of the upper component 3 when the upper and lower components 3 and 4 are assembled with each other, as shown in FIG. 5.

According to this embodiment, an inverted L-shaped coupling portion fixing engaging portion 4*j* (see FIG. 7) is provided on the coupling portion 4*c* of the lower component 4 along arrow D for vertically engaging with the L-shaped coupling portion fixing engaging portion 3*i* of the upper component 3, as shown in FIG. 4. The coupling portion fixing engaging portion 4*j* is an example of the "second engaging portion" in the present invention. Further, groove-shaped sliding direction fixing hook engaging portions 4*k* (see FIG. 8) are provided on both outer surfaces of the end of the lower component 4 along arrow C for engaging with the sliding direction fixing hook portions 3*j* of the upper component 3. The sliding direction fixing hook engaging portions 4*k* are examples of the "second hook engaging portions" in the present invention.

The feed bobbin 6 is provided with a sheet feed shaft 6*a* wound with the ink sheet 5 to be fed, a flange 6*b*, an engaging portion 6*d* (see FIG. 6) formed closer to the drive shaft 6*c* with three recess portions for engaging with a bobbin driving roll of a printer (not shown) and a driven shaft 6*e*, as shown in FIG. 1.

The take-up bobbin 7 is provided with a sheet take-up shaft 7*a* taking up the ink sheet 5 fed from the feed bobbin 6, a flange 7*b*, a drive shaft 7*c*, an engaging portion 7*d* (see FIG. 6) formed closer to the drive shaft 7*c* with three recess portions for engaging with another bobbin driving roll of the printer (not shown) and a driven shaft 7*e*, as shown in FIG. 1.

A method of assembling the upper and lower components 3 and 4 of the ink sheet cartridge 1 according to this embodiment is now described with reference to FIGS. 1, 4 and 7 to 15. First, the helical coil springs 8 are set on the driven shafts 6*e* and 7*e* of the feed bobbin 6 and the take-up bobbin 7 respectively, as shown in FIGS. 1 and 4. As shown in FIG. 4, the feed bobbin 6 and the take-up bobbin 7 are arranged to be supported by the feed bobbin support portion 4*e* and the take-up bobbin support portion of the feed bobbin storage portion 4*a* and the take-up bobbin storage portion 4*b* of the lower component 4 respectively. In this state, the helical coil springs 8 urge the feed bobbin 6 and the take-up bobbin 7 along arrows E respectively, as shown in FIG. 4.

Figure 10:
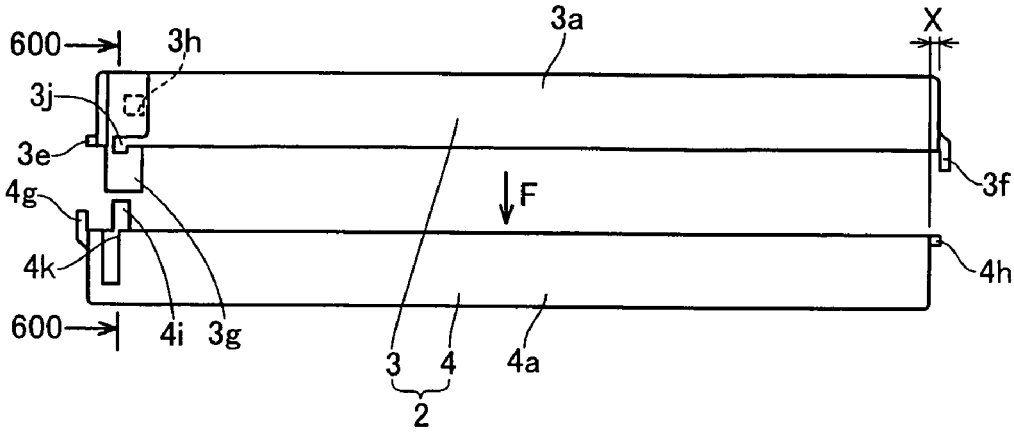
FIG. 10 is a side elevational view for illustrating a method of assembling the ink sheet cartridge according to the embodiment of the present invention shown in FIG. 1.
Figure 11:
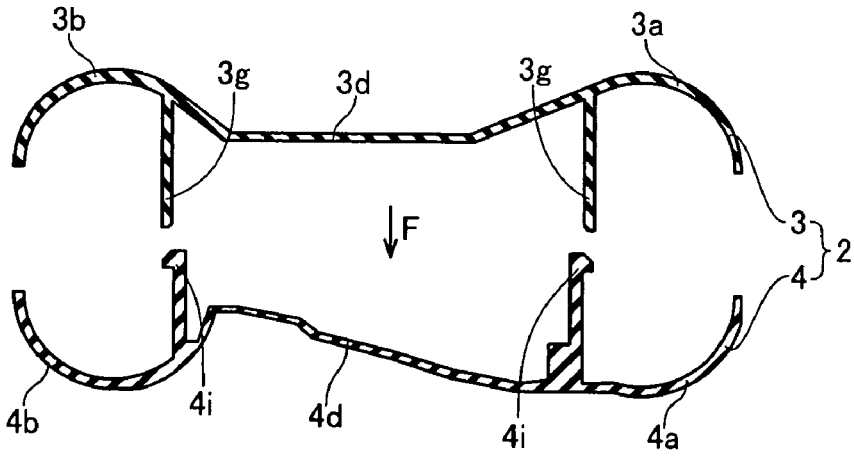
FIG. 11 is a sectional view taken along the line 600-600 in FIG. 10.
Figure 12:
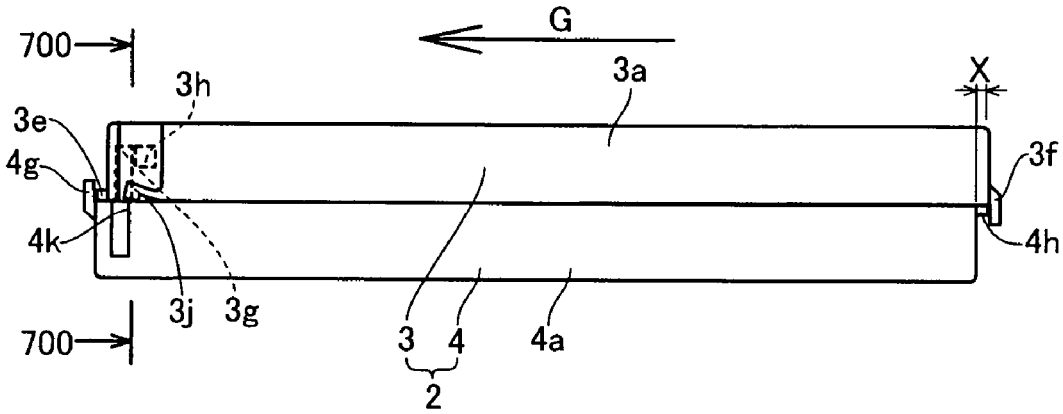
FIG. 12 is another side elevational view for illustrating the method of assembling the ink sheet cartridge according to the embodiment of the present invention shown in FIG. 1.
Figure 13:
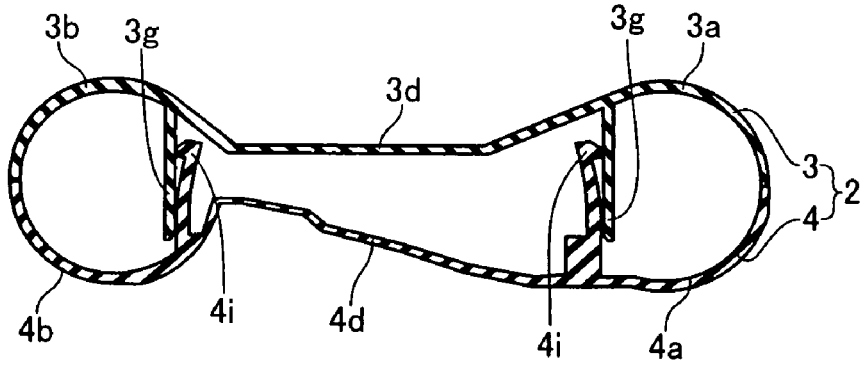
FIG. 13 is a sectional view taken along the line 700-700 in FIG. 12.

As shown in FIG. 10, the upper component 3 is arranged on the lower component 4 in a state deviated from the lower component 4 by a prescribed distance X. At this time, the hook portions 4*i* of the lower component 4 are located under the hook engaging portions 3*g* of the upper component 3, as shown in FIG. 11. Then, the upper component 3 is moved along arrow F in FIG. 10, and superposed on the lower component 4 as shown in FIG. 12. In this state, the forward ends of the hook portions 4*i* of the lower component 4 are not yet engaged with the engaging holes 3*h* of the hook engaging portions 3*g*, constituted of plate members, of the upper component 3 but in contact with portions close to the engaging holes 3*h*, as shown in FIGS. 12 and 13. When in contact with the hook engaging portions 3*g*, the hook portions 4*i* are elastically deflected, as shown in FIG. 13.

Figure 9:
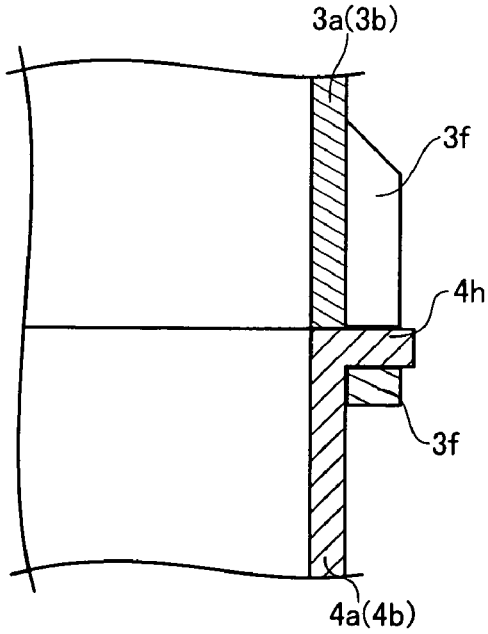
FIG. 9 is a sectional view taken along the line 500-500 in FIG. 6.
Figure 14:
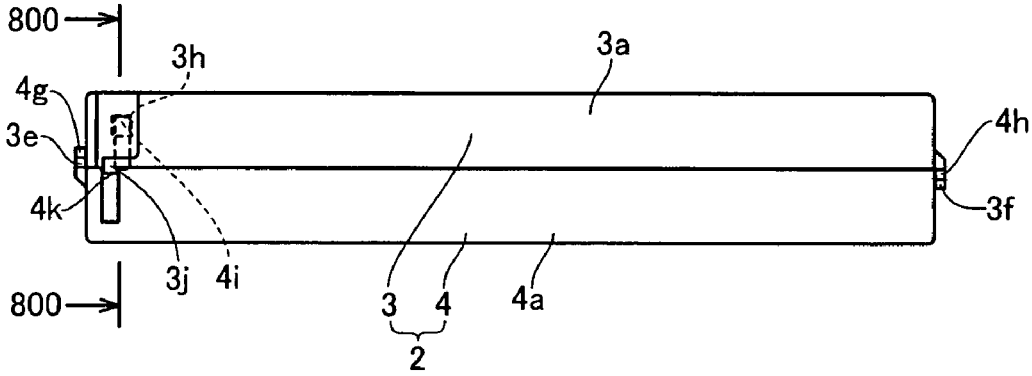
FIG. 14 is still another side elevational view for illustrating the method of assembling the ink sheet cartridge according to the embodiment of the present invention shown in FIG. 1.
Figure 15:
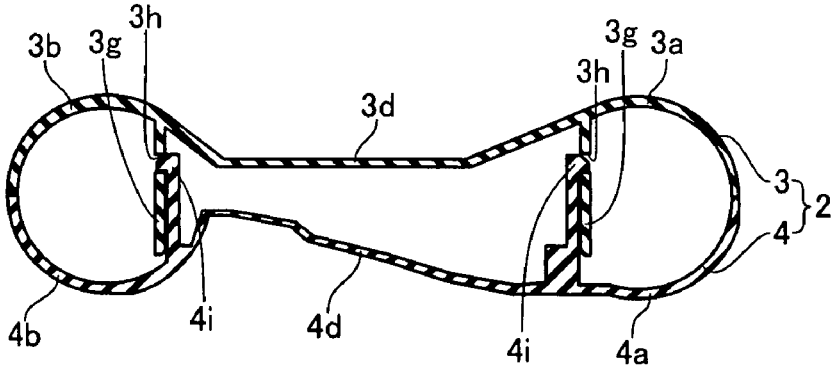
FIG. 15 is a sectional view taken along the line 800-800 in FIG. 14.
Figure 16:
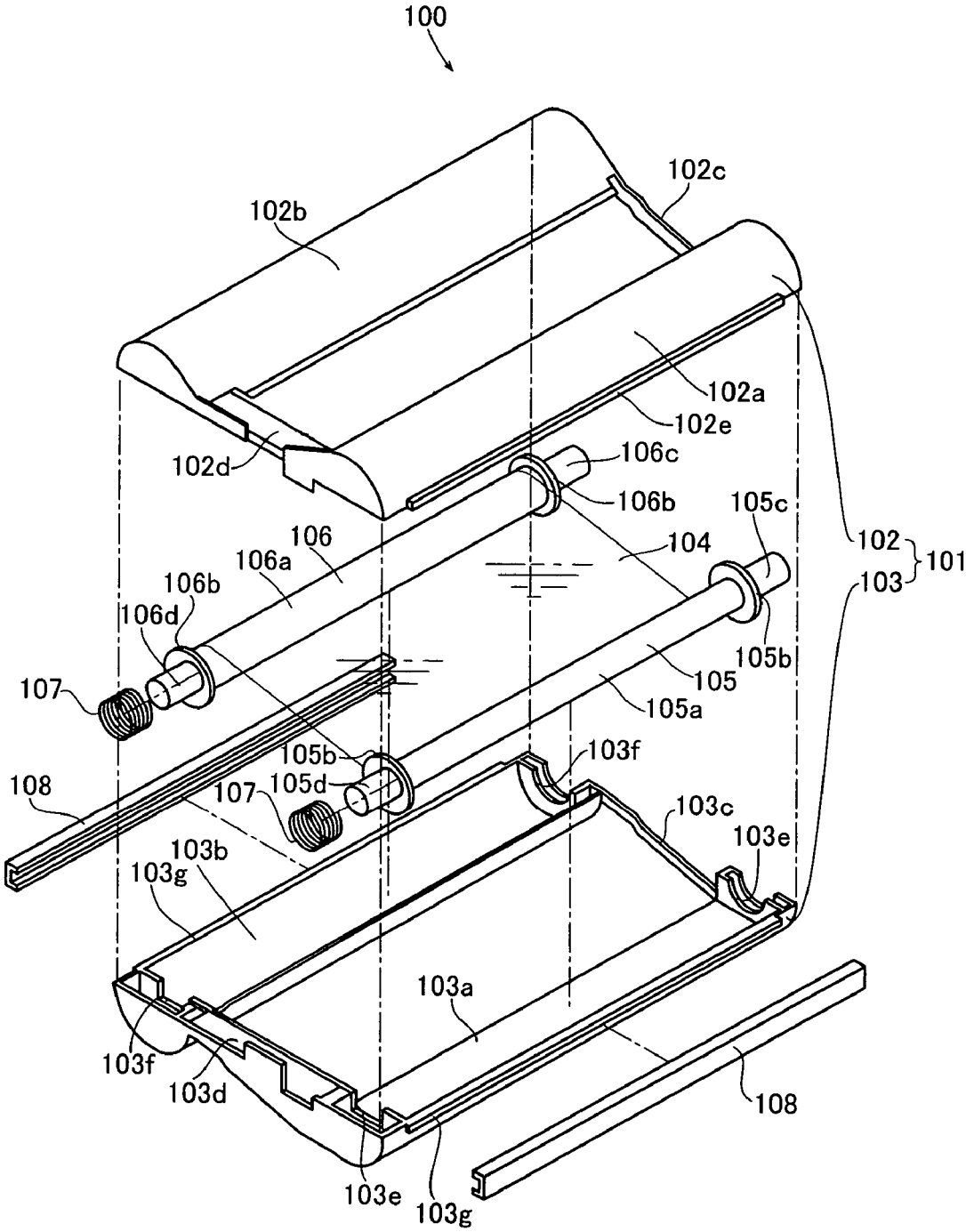
FIG.16 PRIOR ART
FIG. 16 is an exploded perspective view of a conventional ink sheet cartridge employed for a thermal transfer printer.
Figure 17:
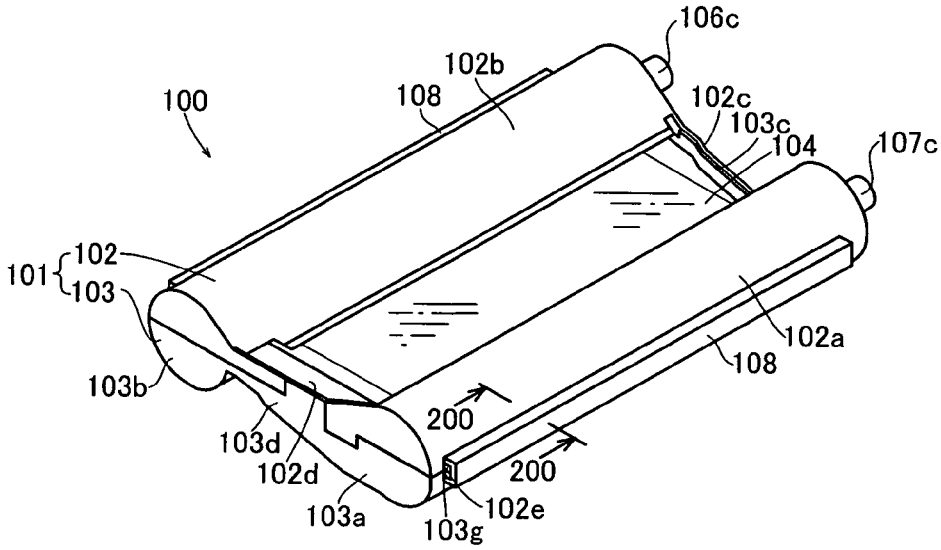
FIG.17 PRIOR ART
FIG. 17 is an overall perspective view of the conventional ink sheet cartridge employed for a thermal transfer printer.
Figure 18:
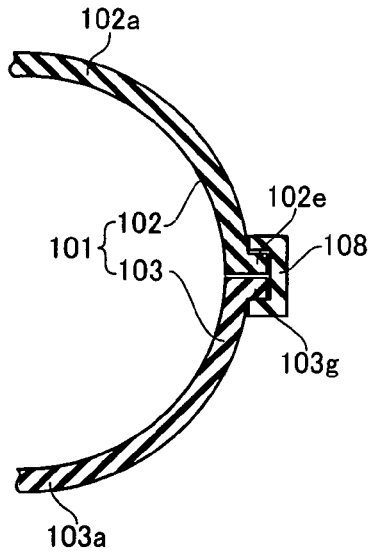
FIG.18 PRIOR ART
FIG. 18 is a sectional view taken along the line 200-200 in FIG. 17.

According to this embodiment, the upper component 3 is slid along arrow G (in the horizontal direction) in FIG. 12 with respect to the lower component 4, thereby inserting the protrusions 3*e* of the upper component 3 into the fitting portions 4*g* (see FIG. 9) of the lower component 4, as shown in FIG. 12. At the same time, the protrusions 4*h* of the lower component 4 are inserted into the fitting portions 3*f* of the upper component 3, as shown in FIG. 9. Thus, the upper and lower components 3 and 4 are inhibited from vertical separation. Further, the forward ends of the hook portions 4*i* of the lower component 4 having been in contact with the portions close to the engaging holes 3*h* of the hook engaging portions 3*g* of the upper component 3 reach the positions of the engaging holes 3*h* of the hook engaging portions 3*g* due to the sliding of the upper component 3 along arrow G (see FIG. 12), as shown in FIG. 14. Thus, the hook portions 4*i* are restored from the elastically deflected state, so that the forward ends thereof engage with the engaging holes 3*h* of the hook engaging portions 3*g* as shown in FIG. 15. The forward ends of the hook portions 4*i* engage with the engaging holes 3*h* of the hook engaging portions 3*g* with no vertical clearances, thereby inhibiting the upper and lower components 3 and 4 from vertical separation.

Figure 8:
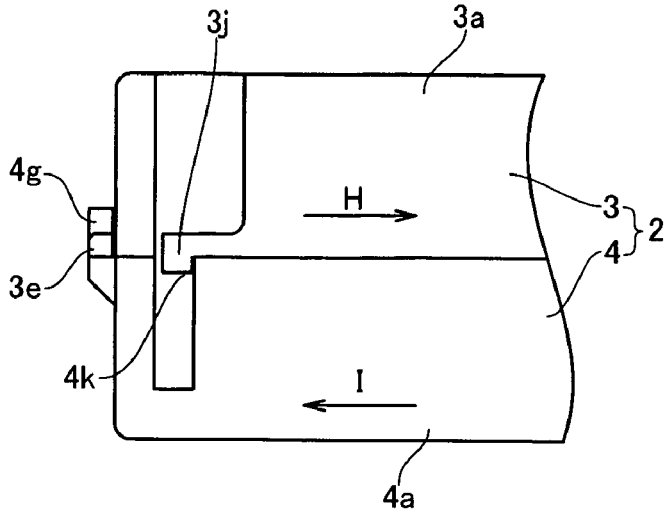
FIG. 8 is an enlarged view of a side surface of the ink sheet cartridge according to the embodiment of the present invention shown in FIG. 1.

According to this embodiment, the upper component 3 is so slid along arrow G (in the horizontal direction) in FIG. 12 with respect to the lower component 4 that the sliding direction fixing hook portions 3*j* of the upper component 3 engage with the sliding direction fixing hook engaging portions 4*k* as shown in FIGS. 8 and 14. Thus, the upper component 3 and the lower component 4 are inhibited from movement in the sliding direction along arrows H and I respectively, as show in FIG. 8.

Figure 7:
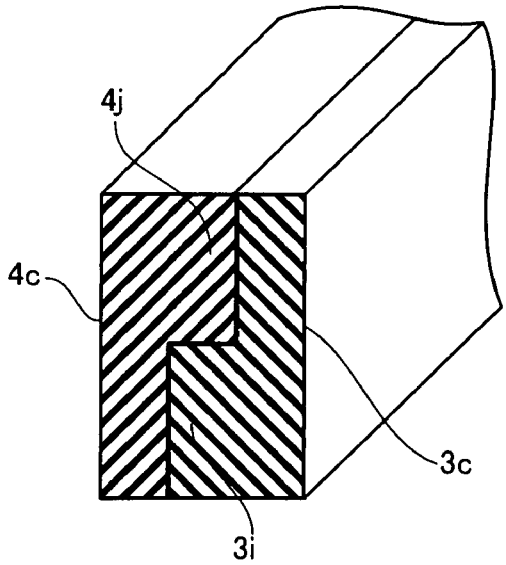
FIG. 7 is a sectional view taken along the line 400-400 in FIG. 6.

According to this embodiment, further, the upper component 3 is so slid along arrow G (in the horizontal direction) in FIG. 12 with respect to the lower component 4 that the inverted L-shaped coupling portion fixing engaging portion 3*i* provided on the coupling portion 3*c* of the upper component 3 engages with the L-shaped coupling portion fixing engaging portion 4*j* provided on the coupling portion 4*c* of the lower component 4, as shown in FIG. 7. Thus, the coupling portions 3*c* and 4*c* of the upper and lower components 3 and 4 are inhibited from vertical separation.

The upper and lower components 3 and 4 of the ink sheet cartridge 1 according to this embodiment are assembled with each other in the aforementioned manner.

According to this embodiment, as hereinabove described, the lower component 4 is integrally provided with the hook portions 4*i* while the upper component 3 is integrally provided with the hook engaging portions 3*g* engaging with the hook portions 4*i* in the vertical direction and the sliding direction (horizontal direction), whereby the number of components can be inhibited from increase despite the provision of the hook portions 4*i* and the hook engaging portions 3*g* and the upper and lower components 3 and 4 can be fixed to each other in the vertical direction and the sliding direction (horizontal direction) through the hook portions 4*i* and the hook engaging portions 3*g* without employing an adhesive.

According to this embodiment, the upper component 3 is slid along arrow G (in the horizontal direction) with respect to the lower component 4 in the state deviated from the lower component 4 by the prescribed distance X thereby engaging the hook portions 4*i* with the hook engaging portions 3*g* and fixing the upper and lower components 3 and 4 to each other so that no load is applied except in the sliding direction when the upper component 3 is slid along arrow G with respect to the lower component 4, whereby the upper component 3 or the lower component 4 can be inhibited from deflection dissimilarly to a case of vertically fixing the upper and lower components 3 and 4 to each other while deflecting either the upper component 3 or the lower component 4. Therefore, the feed bobbin 6 and the take-up bobbin 7 stored in the ink sheet cartridge 1 are not displaced by deflection of the upper or lower component 3 or 4, whereby the upper and lower components 3 and 4 can be easily fixed to each other.

According to this embodiment, the coupling portions 3*c* and 4*c* coupling the feed bobbin storage portions 3*a* and 4*a* and the take-up bobbin storage portions 3*b* and 4*b* with each other are provided in the vicinity of the side end surfaces of the upper and lower components 3 and 4 along arrow D respectively while the coupling portion fixing engaging portions 3*i* and 4*j* are provided on the coupling portions 3*c* and 4*c* of the upper and lower components 3 and 4 respectively for vertically engaging with each other when the upper component 3 is slid along arrow G (in the horizontal direction) with respect to the lower component 4 in the state deviated from the lower component 4 by the prescribed distance X, whereby the coupling portions 3*c* and 4*c* of the upper and lower components 3 an 4 can be inhibited from vertical deviation without employing an adhesive due to the engagement between the coupling portion fixing engaging portions 3*i* and 4*j*.

According to this embodiment, the pair of protrusions 3*e* are provided in the vicinity of both ends of the side end surface of the upper component 3 along arrow C while the pair of fitting portions 4*g* vertically engaging with the pair of protrusions 3*e* are provided in the vicinity of both ends of the side end surface of the upper component 3 along arrow C and the pair of fitting portions 3*f* are provided in the vicinity of both ends of the side end surface of the upper component 3 along arrow D while the pair of protrusions 4*h* vertically engaging with the pair of fitting portions 3*f* are provided in the vicinity of both ends of the side end surface of the lower component 4 along arrow D for sliding the upper component 3 along arrow G (in the horizontal direction) with respect to the lower component 4 in the state deviated from the lower component 4 by the prescribed distance X thereby inserting the pairs of protrusions 3*e* and 4*h* into the pairs of fitting portions 4*g* and 3*f* respectively for vertically fixing four corners of the upper component 3 and those of the lower component 4 to each other upon assembling of the upper and lower components 3 and 4, whereby the corners of the upper and lower components 3 and 4 can be inhibited from vertical separation.

According to this embodiment, the sliding direction fixing hook portions 3*j* for fixing the sliding direction (horizontal direction) of the upper and lower components 3 and 4 are provided on the outer surfaces of the feed bobbin storage portion 3*a* and the take-up bobbin storage portion 3*b* of the upper component 3 to extend substantially in parallel with the extensional direction of the feed bobbin storage portion 3*a* and the take-up bobbin storage portion 3*b* of the upper component 3 while the sliding direction fixing hook engaging portions 4*k* engaging with the sliding direction fixing hook portions 3*j* are provided on the outer surfaces of the feed bobbin storage portion 4*a* and the take-up bobbin storage portion 4*b* of the lower component 4 for inhibiting the upper or lower component 3 or 4 from movement in the sliding direction due to engagement between the sliding direction fixing hook portions 3*j* and the sliding direction fixing hook engaging portions 4*k*, whereby the upper and lower components 3 and 4 can be inhibited from cancellation of the fixed state.

According to this embodiment, the coupling portions 3*d* and 4*d* coupling the feed bobbin storage portions 3*a* and 4*a* and the take-up bobbin storage portions 3*b* and 4*b* with each other are provided in the vicinity of the side end surfaces of the upper and lower components 3 and 4 along arrow C respectively while the pair of hook engaging portions 3*g* constituted of the plate members having the engaging holes 3*h* are provided on the positions of the upper component 3 closer to the coupling portion 3*d* than the protrusions 3*e* and the pair of hook portions 4*i* are provided on the positions of the lower component 4 closer to the coupling portion 4*d* than the fitting portions 4*g* so that the hook portions 4*i* and the hook engaging portions 3*g* can easily engage with each other in the vicinity of the coupling portions 3*d* and 4*d*, whereby the coupling portions 3*d* and 4*d* can be inhibited from separation.

Although the present invention has been described and illustrated in detail, it is clearly understood that the same is by way of illustration and example only and is not to be taken by way of limitation, the spirit and scope of the present invention being limited only by the terms of the appended claims.

For example, while the pair of protrusions and the pair of fitting portions are provided on both side ends of the ink sheet cartridge for engaging with each other when either the upper component or the lower component is horizontally slid in the aforementioned embodiment, the present invention is not restricted to this but the pair of protrusions and the pair of engaging portions may alternatively be provided only on one side end of the ink sheet cartridge for engaging with each other when either the upper component or the lower component is horizontally slid.

While the pair of hook portions are provided in the vicinity of the coupling portions of the lower component while the pair of hook engaging portions engaging with the pair of hook portions are provided in the vicinity of the coupling portions of the upper component in order to vertically fix the upper and lower components to each other in the aforementioned embodiment, the present invention is not restricted to this but the pair of hook portions may alternatively be provided in the vicinity of the coupling portions of the upper component while providing the pair of hook engaging portions in the vicinity of the coupling portions of the lower component. Further alternatively, the pair of hook portions and the pair of hook engaging portions may be provided on positions other than those in the vicinity of the coupling portions. In addition, one or at least three hook portions and one or at least three hook engaging portions may be provided for vertically fixing the upper and lower components to each other.

While the coupling portions of the upper and lower components are provided with the L-shaped and inverted L-shaped engaging portions engaging with each other in the aforementioned embodiment, the present invention is not restricted to this but the coupling portions may alternatively be provided with engaging portions having shapes other than the L and inverted L shapes.

While the sliding direction fixing hook portions are provided on both outer surfaces of the upper component while the sliding direction fixing hook engaging portions engaging with the sliding direction fixing hook portions are provided on both side surfaces of the lower component for inhibiting the upper or lower component from horizontal sliding in the aforementioned embodiment, the present invention is not restricted to this but the ink sheet cartridge may alternatively be provided with no sliding direction fixing hook portions and no sliding direction fixing hook engaging portions.

What is claimed is:

1. An ink sheet cartridge comprising:

an ink sheet for printing;

a first case portion and a second case portion, each including a pair of ink sheet storage portions storing said ink sheet;

a first hook portion integrally provided on either said first case portion or said second case portion; and a first hook engaging portion integrally provided on either said second case portion or said first case portion for engaging with said first hook portion;

wherein either said first case portion or said second case portion is slid in an extensional direction of said ink sheet storage portions while deviating said first case portion and said second case portion from each other by a prescribed distance, thereby engaging said first hook portion with said first hook engaging portion and fixing said first case portion and said second case portion to each other, a first protrusion is provided in the vicinity of each end of a side end surface of said first case portion while a first fitting portion receiving said first protrusion is provided in the vicinity of each end of a side end surface of said second case portion, a second fitting portion is provided in the vicinity of each end of another side end surface of said first case portion while a second protrusion is inserted into said second fitting portion provided in the vicinity of each end of another side end surface of said second case portion, and each first protrusion is inserted into one said first fitting portion and each second protrusion is inserted into one said second fitting portion when either said first case portion or said second case portion is slid in the extensional direction of said ink sheet storage portions while said first case portion and said second case portion are deviated from each other by said prescribed distance.

2. The ink sheet cartridge according to claim 1, wherein said first case portion is arranged on said second case portion, said first protrusions of said first case portion and said first fitting portions of said second case portion vertically engage with each other, and said second fitting portions of said first case portion and said second protrusions of said second case portion vertically engage with each other.

3. The ink sheet cartridge according to claim 1, wherein a first coupling portion and a second coupling portion coupling said pair of ink sheet storage portions with each other are provided in the vicinity of both side end surfaces of said first case portion respectively, a third coupling portion and a fourth coupling portion coupling said pair of ink sheet storage portions with each other are provided in the vicinity of both side end surfaces of said second case portion respectively, a pair of said first hook portions are provided either on a side of said first case portion closer to said second coupling portion than said first protrusions or on a side of said second case portion closer to said fourth coupling portion than said first fitting portions, and a pair of said first hook engaging portions are provided either on said side of said second case portion closer to said fourth coupling portion than said first fitting portions or on said side of said first case portion closer to said second coupling portion than said first protrusions.

4. An ink sheet cartridge comprising:

an ink sheet for printing; and a first case portion and a second case portion each including a pair of ink sheet storage portions storing said ink sheet, wherein said first case portion is integrally provided with a first hook engaging portion, said second case portion is integrally provided with a first hook portion engaging with said first hook engaging portion, a first coupling portion and a second coupling portion coupling said pair of ink sheet storage portions with each other are provided in the vicinity of both side end surfaces of said first case portion respectively, a third coupling portion and a fourth coupling portion coupling said pair of ink sheet storage portions with each other are provided in the vicinity of both side end surfaces of said second case portion respectively, a first protrusion is provided in the vicinity of each end of a side end surface of said first case portion while a first fitting portion receiving said first protrusion is provided in the vicinity of each end of a side end surface of said second case portion, a second fitting portion is provided in the vicinity of each end of another side end surface of said first case portion while a second protrusion is inserted into said second fitting provided in the vicinity of each end of another side end surface of said second case portion, second hook portions for fixing the sliding direction of said first case portion and said second case portion are provided on the outer surfaces of said ink sheet storage portions of said first case portion to extend substantially in parallel with the extensional direction of said ink sheet storage portions, second hook engaging portions engaging with said second hook portions are provided on the outer surfaces of said ink sheet storage portions of said second case portion, a pair of said first hook engaging portions are provided on a side of said first case portion closer to said second coupling portion than said first protrusions, a pair of said first hook portions are provided on a side of said second case portion closer to said fourth coupling portion than said first fitting portions, said first coupling portion of said first case portion and said third coupling portion of said second case portion are provided with a first engaging portion and a second engaging portion engaging with each other respectively, and either said first case portion or said second case portion is slid in an extensional direction of said ink sheet storage portions while deviating said first case portion and said second case portion from each other by a prescribed distance thereby engaging said first hook portions with said first hook engaging portions, each first protrusion is inserted into one said first fitting portion and each second protrusion is inserted into one said second fitting portion while engaging said first engaging portion of said first coupling portion and said second engaging portion of said third coupling portion with each other thereby fixing said first case portion and said second case portion to each other.

5. The ink sheet cartridge according to claim 4, wherein said first hook engaging portions include engaging holes engaging with said first hook portions.

6. The ink sheet cartridge according to claim 4, wherein said first hook portions and said first hook engaging portions engage with each other at least in the vertical direction.

7. The ink sheet cartridge according to claim 4, wherein said first hook portions are provided on regions corresponding to said pair of ink sheet storage portions of either said first case portion or said second case portion respectively, and said first hook engaging portions are provided on regions corresponding to said pair of ink sheet storage portions of either said second case portion or said first case portion respectively.

8. The ink sheet cartridge according to claim 4, wherein said first case portion is arranged on said second case portion, and said first engaging portion of said first case portion and said second engaging portion of said second case portion vertically engage with each other.

9. The ink sheet cartridge according to claim 4, wherein said first case portion is arranged on said second case portion, said first protrusions of said first case portion and said first fitting portions of said second case portion vertically engage with each other, and said second fitting portions of said first case portion and said second protrusions of said second case portion vertically engage with each other.

10. The ink sheet cartridge according to claim 4, wherein said second hook portions of said first case portion and said second hook engaging portions of said second case portion engage with each other in the sliding direction.

* * * * *